United States Patent [19]

Smith

[11] 4,154,380

[45] May 15, 1979

[54] EXTERNALLY REPLACEABLE METAL CASTING NOZZLE

[75] Inventor: Robert W. Smith, Long Valley, N.J.

[73] Assignee: Allied Chemical Corporation, Morristown, N.J.

[21] Appl. No.: 820,526

[22] Filed: Aug. 1, 1977

[51] Int. Cl.[2] ..... B22D 41/08; B22D 11/00; B22D 11/10

[52] U.S. Cl. ..... 222/591; 164/423; 164/437

[58] Field of Search ..... 164/66, 200, 201, 202, 164/412, 423, 437; 222/591, 568, 591; 239/391, 396

[56] References Cited

U.S. PATENT DOCUMENTS

| | | | |
|---|---|---|---|
| 3,522,835 | 8/1970 | Khimich | 222/591 X |
| 3,735,906 | 5/1973 | Zettlemoyer | 222/591 |
| 3,949,905 | 4/1976 | Nikolov et al. | 222/568 X |
| 3,982,582 | 9/1976 | Knorr et al. | 222/591 X |

FOREIGN PATENT DOCUMENTS

| | | | |
|---|---|---|---|
| 534538 | 1/1955 | Belgium | 239/396 |
| 1083262 | 9/1967 | United Kingdom | 222/591 |

*Primary Examiner*—Richard B. Lazarus
*Assistant Examiner*—John S. Brown
*Attorney, Agent, or Firm*—Gerhard H. Fuchs; David W. Collins

[57] ABSTRACT

Metal filament forming apparatus including a casting crucible having a tapping orifice and a casting nozzle for ejecting molten metal from the crucible are described. The casting nozzle is characterized by having an externally replaceable orifice member. The casting nozzle comprises three parts: (1) a nozzle body providing a conduit for the molten metal in association with the tapping orifice; (2) a replaceable orifice member positioned at the lower end of the nozzle body; and (3) retaining means for holding the replaceable orifice member in sealing engagement with the nozzle body. The crucible is preferably provided with a stopper rod to permit discontinuation of metal flow through the nozzle, while holding molten metal in the crucible.

5 Claims, 8 Drawing Figures

EXTERNALLY REPLACEABLE METAL CASTING NOZZLE

BACKGROUND OF THE INVENTION

This invention relates to casting nozzles used in casting filaments from molten metal sources. More particularly, it relates to nozzles for use in processes for making continuous metal strips, particularly metal strips with an amorphous molecular structure, by bringing molten metal into contact with a chill body by forcing it through a nozzle.

Methods for making finished or semifinished metal products such as wire, ribbon or sheet, directly from the molten metal are known. These may involve, for example, jetting molten metal through a nozzle and cooling it, either in free flight or by contact with a chill body, to obtain continuous filament. Characteristically, these processes involve jetting of molten metal through an orifice under pressure. Typically, the molten metal is pressurized in a crucible, which crucible has a bottom outlet in the form of an orifice in the shape of the desired cross-section of the metal jet. Usually, the orifices of the casting nozzles are of small size, say in the order of about 0.01 to about 0.05 inch diameter, and they plug easily in operation. Unplugging is dangerous, since there is maintained a body of molten metal above the orifice.

The present invention provides a nozzle for casting metal which is externally replaceable.

SUMMARY OF THE INVENTION

In accordance with the present invention, there is provided metal filament forming apparatus including, in combination, a crucible with an associated casting nozzle. The crucible is adapted to hold molten metal. It has a tapping orifice in the bottom. Seated in the tapping orifice is a casting nozzle adapted for ejecting molten metal from said crucible into contact with a quench medium. The casting nozzle comprises at least three parts: a nozzle body; a replaceable orifice member; and retaining means for holding the replaceable orifice member in sealing engagement with the nozzle body. The nozzle body provides a conduit for passing molten metal therethrough. One end of the nozzle body is adapted to be received by the tapping orifice of the crucible in sealing engagement. The opposite end of the nozzle body is adapted to receive the replaceable orifice member in sealing engagement. The replaceable orifice member is provided with at least one duct for extruding molten metal therethrough. The duct of the replaceable orifice member is in communication with the conduit of the nozzle body. The retaining means serves to hold the replaceable orifice member in sealing engagement with the nozzle body. Desireably, the crucible is provided with a stopper rod adapted to close off the tapping orifice to discontinue flow of molten metal therethrough. With the stopper rod in closed position, it is possible to release the retaining means and to remove the replaceable orifice member while maintaining a pool of molten metal in the crucible without disturbing the nozzle body, and to replace the orifice member.

The apparatus of the present invention is particularly suited for use in connection with the stopper rod tapping assembly described in U.S. Pat. No. 3,964,535 issued June 22, 1976 to Bedell et al.

BRIEF DESCRIPTION OF THE DRAWINGS

The present invention may be better understood with reference to the annexed drawings, wherein.

In the drawings, like references numerals denote like parts.

DETAILED DESCRIPTION OF THE INVENTION

Figure 1:
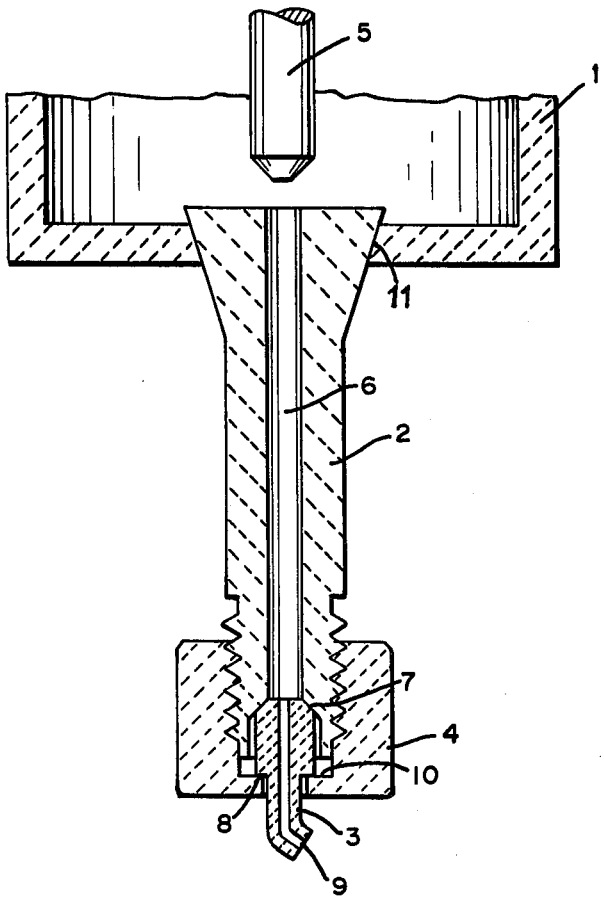
FIG. 1 is a cross-sectional view of a crucible with associated casting nozzle.

With reference to FIG. 1, there is shown crucible 1 having a tapping orifice, nozzle body 2, replaceable orifice member 3, and retaining means 4. Nozzle body 2, replaceable orifice member 3 and retaining means 4 together comprise the casting nozzle for ejecting molten metal from crucible 1 into contact with a quench medium (not shown). Nozzle body 2 provides a conduit 6 for passing molten metal therethrough. The upper end of nozzle body 2 is adapted to be received by the tapping orifice in sealing engagement. In FIG. 1 of the drawings, a tapered seal 11 is illustrated. Many other means for effecting seal between the nozzle body and the crucible are possible and will readily occur to those skilled in the art. The opposite end of nozzle body 2 is adapted to receive replaceable orifice member 3. To that end, a tapered section may be provided in conduit 6 of nozzle body 2, adapted for sealing engagement with tapered top 7 of replaceable orifice member 3 (see FIGS. 2 and 3). Replaceable orifice member 3 is provided with at least one duct 9 for extruding molten metal therethrough, which duct is in communication with conduit 6 of nozzle body 2. Replaceable orifice member 3 is held in sealing engagement with nozzle body 2 by retaining means 4. To that end, replaceable orifice member 3 may be provided with a shoulder 8 which, when replaceable orifice member 3 is inserted into nozzle body 2 for sealing engagement, extends past the end of nozzle body 2. Retaining means 4 is provided in the form of a screw cap, the female threads of which are adapted to engage mating male threads at the lower portion of nozzle body 2. Retaining means 4 is provided with an aperture designed to pass the lower end of replaceable orifice member 3 therethrough, but small enough to provide a shoulder 10 (see FIGS. 1 and 3) for engagement with shoulder 8 of replaceable orifice member 3 to bring and hold upper tapered section 7 of replaceable orifice member 3 in sealing engagement with the tapered section of duct 6 of nozzle body 2. In operation, when molten metal is held in crucible 1, the replaceable orifice member 3 can readily be replaced by lowering stopper rod 5 for sealing engagement with the inlet of duct 6 of nozzle body 2 to terminate flow of metal through duct 6. Once flow of metal is terminated, retaining means 4 can be unscrewed and replaceable orifice member 3 withdrawn from the nozzle body. So withdrawn, replaceable orifice member 3 can be cleaned, or a substitute member can be provided, be inserted into nozzle body 2, and be held in place by replacing retaining means 4. Thus, the nozzle can be reworked with no loss of material or equipment during the casting operation. Hazard of need for emptying the crucible of molten metal in order to save internal parts from being destroyed by solidifying metal is eliminated.

Figure 2:
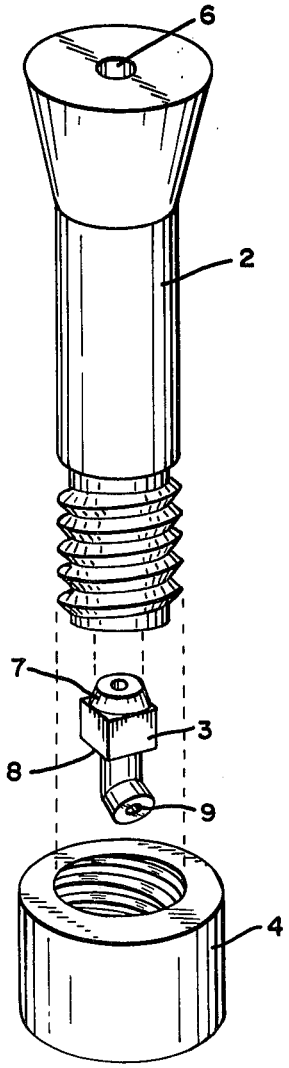
FIG. 2 is an exploded view of the components of the casting nozzle.

FIG. 2 shows an exploded view of the essential component parts of the nozzle and illustrates their assembly.

Figure 3:
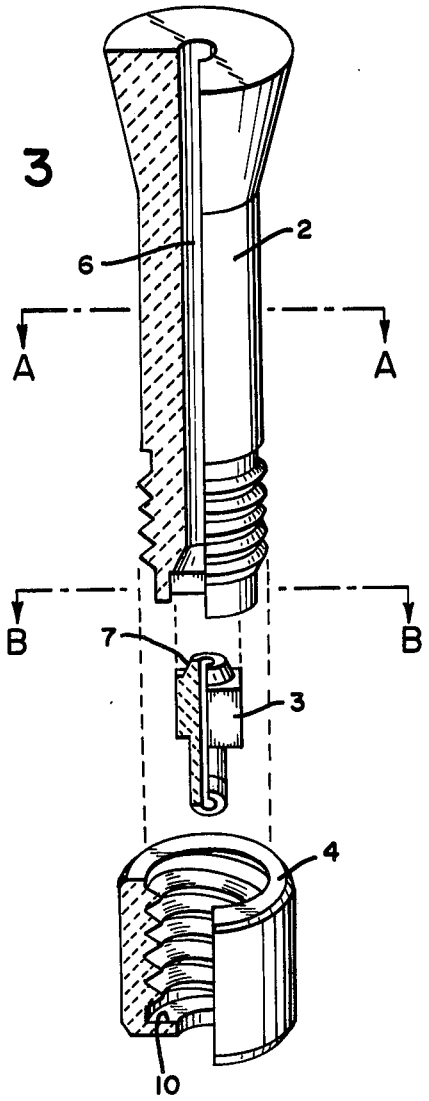
FIG. 3 is an exploded view in partial cross-section of a casting nozzle.
Figure 4:
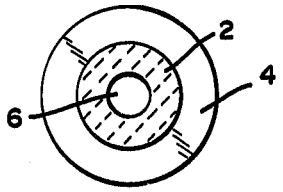
FIG. 4 is a cross-sectional view along lines AA of the casting nozzle body shown in FIG. 3.
Figure 5:
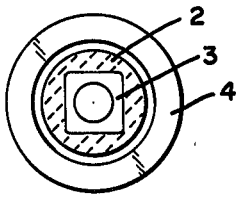
FIG. 5 is a cross-sectional view of the nozzle body shown in FIG. 3 along lines BB.

When the replaceable orifice member 3 is adapted to extrude metal in direction other than in alignment with duct 6 of nozzle body 2, as is illustrated in FIGS. 1, 2 and 3, then it is desirable to provide means for indexing replaceable orifice member 3 to insure that its orifice is pointed in desired direction. This may be simply accomplished by shaping the body of replaceable orifice member 3 in some irregular form, such as in polygonal cross-section, to be received by a matingly formed lower section of duct 6 of nozzle body 2. Thus, in FIGS. 2 and 3 replaceable orifice member is provided with a rectangular shaped main body section above shoulder 8 to be received in a mating rectangular section of duct 6. FIG. 5 representing a cross-sectional view of the nozzle body illustrated in FIG. 3 along lines BB illustrates such rectangular lower portion of duct 6. The upper portion of duct 6 may be round, as illustrated in FIG. 4, which is a cross-sectional view of duct 2 along lines AA in FIG. 3.

Figure 8:
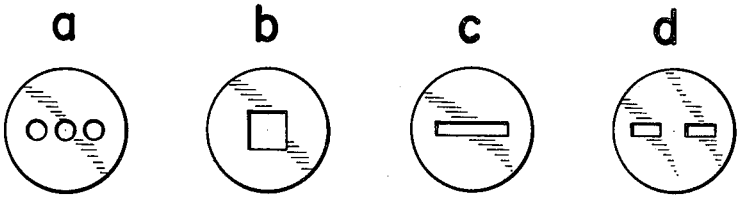
FIG. 8 shows four views depicting arrangement and shapes of orifices in the replaceable orifice member as seen from a direction opposite that in which the metal is ejected through the orifice(s), designated a, b, c and d.
Figure 6:
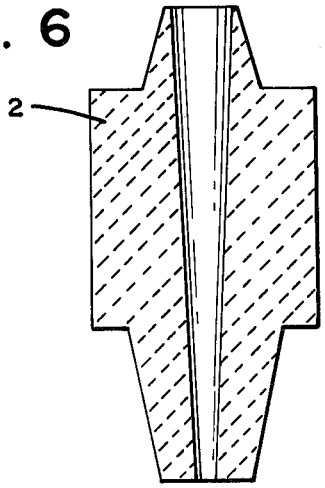
FIGS. 6 and 7 are cross-sectional views of embodiments of replaceable orifice members.
Figure 7:
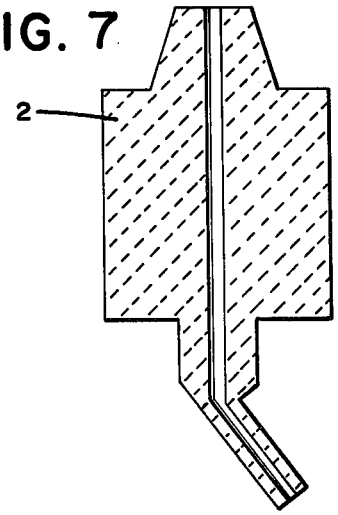

The replaceable orifice member 2 may be provided with one or more ducts. The duct may be tapered, as illustrated in FIG. 6, or of equal diameter throughout, as illustrated in FIG. 1. It may be straight, as illustrated in FIG. 6, or angled, as illustrated in FIGS. 1, 2, 3 and 7. In FIG. 7, replaceable orifice member 3 is provided with an extension, as may be desirable to provide greater lengths to diameter ratio for the duct. The duct(s) may terminate in a round orifice, as illustrated in FIG. 8*a*, a square orifice, as illustrated in FIG. 8*b*, or a rectangular orifice as illustrated in FIGS. 8*c* and 8*d*, or in any other desired shape. Multiple orifices may be provided, as illustrated in FIGS. 8*a* and 8*d*.

The crucible, nozzle and stopper rod may be fabricated from any material capable of withstanding the melt temperature and similar stresses. Typical materials include boron nitride, graphite, alumina, silica, stabilized zirconia and beryllia. Boron nitride is a preferred material of construction for the nozzle, graphite being a preferred material for the crucible.

What is claimed is:

1. Metal filament forming apparatus comprising, in combination:

(A) a crucible adapted to hold molten metal, having a tapered tapping orifice in the bottom and, seated in the tapping orifice (B) a casting nozzle for ejecting molten metal from said crucible into contact with a quench medium, said casting nozzle comprising:

(a) a nozzle body providing a conduit for passing molten metal therethrough, having an externally tapered upper end adapted to be received by the tapered tapping orifice in sealing engagement, and an externally threaded and internally tapered lower end, (b) a replaceable orifice member being provided with at least one duct for passing molten metal therethrough, the duct of the replaceable orifice member being in communication with the conduit of said nozzle body, said replaceable orifice member having an externally tapered upper end which is seated in the internal taper of the lower end of the nozzle body in sealing engagement, said replaceable orifice member being further provided with a shoulder intermediate its upper and lower ends, said shoulder engaging, (c) a retaining nut which is screwed onto the external thread of the lower end of the nozzle body, and through which said replaceable orifice member extends, said retaining nut urging said replaceable orifice member into sealing engagement with said nozzle body.

2. The apparatus of claim 1 wherein the crucible is provided with means for discontinuing metal flow.

3. The apparatus of claim 2 wherein the means for discontinuing metal flow comprises a stopper rod.

4. The apparatus of claim 1 wherein said replaceable orifice member is provided with at least one duct out of alignment with the conduit of said nozzle body, and indexing means are provided for directional alignment of the replaceable orifice member.

5. The apparatus of claim 4 wherein the indexing means are provided by mating irregularly shaped sections of the duct of said nozzle body and the exterior surface of said replaceable orifice member.

* * * * *